US011644244B2

(12) United States Patent
Rosen et al.

(10) Patent No.: US 11,644,244 B2
(45) Date of Patent: May 9, 2023

(54) CURVED HEAT EXCHANGER AND METHOD OF MANUFACTURING

(71) Applicant: MAHLE International GmbH, Stuttgart (DE)

(72) Inventors: John Rosen, Williamsville, NY (US); Scott Kent, Albion, NY (US)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 17/591,683

(22) Filed: Feb. 3, 2022

(65) Prior Publication Data

US 2022/0155015 A1 May 19, 2022

Related U.S. Application Data

(62) Division of application No. 16/558,762, filed on Sep. 3, 2019, now abandoned.

(51) Int. Cl.

| | |
|---|---|
| ***B21D 53/02*** | (2006.01) |
| ***F28D 1/053*** | (2006.01) |
| ***F28F 1/12*** | (2006.01) |
| *F28D 1/02* | (2006.01) |

(52) U.S. Cl.

CPC ..... *F28D 1/05383* (2013.01); *B21D 53/02* (2013.01); *F28F 1/126* (2013.01); *F28D 2001/0273* (2013.01); *F28F 2275/12* (2013.01)

(58) Field of Classification Search

CPC ..... F28D 1/05383; F28D 2001/0273; B21D 53/02; F28F 1/126; F28F 2275/12; F28F 9/0243; F28F 2215/04

See application file for complete search history.

(56) References Cited

U.S. PATENT DOCUMENTS

| | | | | |
|---|---|---|---|---|
| 2,111,534 A * | 3/1938 | Karmazin | F28F 3/086 29/890.047 |
| 3,511,072 A | 5/1970 | Oddy | |
| 3,519,070 A | 7/1970 | Bappler | |
| 4,876,778 A * | 10/1989 | Hagihara | B21D 53/085 29/428 |
| 9,115,939 B2 * | 8/2015 | Huazhao | F28F 1/126 |
| 9,415,436 B2 | 8/2016 | Samuelson et al. | |
| 9,909,818 B2 | 3/2018 | Goodman et al. | |

(Continued)

FOREIGN PATENT DOCUMENTS

| | | |
|---|---|---|
| CN | 102829576 A | 12/2012 |
| CN | 204043463 U | 12/2014 |

(Continued)

*Primary Examiner* — Lawrence Averick

(74) *Attorney, Agent, or Firm* — Dickinson Wright PLLC

(57) ABSTRACT

A heat exchanger has an upper manifold with a first curved section; a lower manifold spaced from and extending parallel to the upper manifold and having a second curved section; a plurality of refrigerant tubes, and a plurality of corrugated fins. Each corrugated fin is formed by a strip having radiused portions alternating with planar portions, and the radiused portions are in contact with the respective adjacent refrigerant tubes. Each of the fins has a curve-inner edge and a curve outer edge and at least one edge of the curve-inner edge and the curve outer edge of at least one fin has a recessed portion in the planar portions that is recessed inward toward a center of the core.

9 Claims, 9 Drawing Sheets

(56) References Cited

U.S. PATENT DOCUMENTS

| | | | | |
|---|---|---|---|---|
| 2003/0234098 | A1 | 12/2003 | Huang | |
| 2006/0237172 | A1 | 10/2006 | Lo | |
| 2006/0237175 | A1* | 10/2006 | Hara | F04D 29/582 180/68.1 |
| 2007/0204977 | A1* | 9/2007 | Beamer | F28D 1/05366 165/124 |
| 2007/0227695 | A1* | 10/2007 | Beamer | F28D 1/05366 165/76 |
| 2008/0141525 | A1* | 6/2008 | Breiding | F28F 9/262 29/726.5 |
| 2008/0202733 | A1* | 8/2008 | Samuelson | F28D 1/05366 165/173 |
| 2009/0000767 | A1 | 1/2009 | Sevakivi | |
| 2009/0321059 | A1 | 12/2009 | Kitazawa | |
| 2011/0289775 | A1* | 12/2011 | Samuelson | B21D 53/06 29/890.03 |
| 2013/0199760 | A1 | 8/2013 | Kadle et al. | |
| 2017/0030658 | A1* | 2/2017 | Liu | F28F 1/128 |
| 2018/0106549 | A1 | 4/2018 | Liu et al. | |
| 2018/0112923 | A1 | 4/2018 | Liu et al. | |

FOREIGN PATENT DOCUMENTS

| | | | |
|---|---|---|---|
| CN | 105258532 | A | 1/2016 |
| EP | 2599565 | A1 | 6/2013 |
| JP | 2013139971 | A | 7/2013 |

* cited by examiner

CURVED HEAT EXCHANGER AND METHOD OF MANUFACTURING

TECHNICAL FIELD

The present disclosure relates to a method of manufacturing a curved heat exchanger with two bent manifolds connected by a heat exchanger core that includes refrigerant tubes and fins.

BACKGROUND

Heat exchangers have various uses in the automotive industry. Some applications require a bent shape heat exchanger. For heat exchangers featuring flat micro-channel refrigerant tubes separated by corrugated fins, the bending process is challenging.

Bending micro-channel heat exchanger cores (MCHX cores) by bending the manifolds causes full width fin centers to crush in various locations, and the center crush varies uncontrollably between different fins along the length of the refrigerant tubes within the bend zone portion of the core. This leads to bent tubes due to irregular deformation of the fins.

SUMMARY

According to the present disclosure, a heat exchanger has an upper manifold having a first curved section; a lower manifold spaced from and extending parallel to the upper manifold and having a second curved section; a plurality of refrigerant tubes, and a plurality of corrugated fins. Each refrigerant tube extends along a tube length from the upper manifold to the lower manifold and is in hydraulic communication with the upper and lower manifolds. Each of the corrugated fins is inserted between respective adjacent ones of the refrigerant tubes so that the refrigerant tubes and corrugated fins define a core having a plurality of air channels from a curve-outer face of the core to a curve-inner face of the core. Each corrugated fin is formed by a strip having radiused portions alternating with planar portions, and the radiused portions are in contact with the respective adjacent refrigerant tubes. Each of the fins has a curve-inner edge and a curve outer edge and at least one edge of the curve-inner edge and the curve outer edge of at least one fin has a recessed portion in the planar portions that is recessed inward toward a center of the core.

According to one aspect of the present disclosure, the recessed portion in the planar portions is bent toward the lower manifold.

Accordingly, the recessed portion may be a central subsection of the planar portions between two subsections of the planar portion, where the edge extends as far outward from the core as the edge of the radiused portions.

The recessed portion may be present in each of the planar portions of the respective fin at least on the curve-inner edge or on the curve outer edge.

The recessed portion may alternatively be present on both the curve-inner edge and the curve outer edge.

Two of the fins that have a recessed edge may be spaced apart by at least one intermediate fin lacking a recessed portion on the side where two adjacent fins have a recessed portion.

In heat exchangers, in which the recessed portion is on the curve-inner edge, a subsection of the curve-inner edge may be folded down to extend downward toward the lower manifold.

Alternatively, the recessed portion may have an incision formed in the at least one edge, the incision extending inward toward the center of the core. In this case, the recessed portion may be on the curve-inner edge, the curve-outer edge, or both.

The cut edge may additionally be bent downward toward the lower manifold in regions laterally adjoining the incision.

In heat exchangers, in which the recessed portion is disposed on both the curve-inner edge and the curve-outer edge of a fin, a subsection of the curve-inner edge may be folded down to extend downward toward the lower manifold and an incision may be formed in the curve-outer edge.

According to a further aspect of the present disclosure, a method of making a curved heat exchanger comprises the following steps:

- assembling parts of the heat exchanger, the parts, after assembly, form a flat heat exchanger including:
  - an upper manifold having a straight elongated shape;
  - an lower manifold spaced from and extending parallel to the upper manifold;
  - a plurality of refrigerant tubes, each refrigerant tube of the plurality of refrigerant tubes extending along a tube length with one tube end attached to the upper manifold and another tube end attached to the lower manifold; and
  - a plurality of corrugated fins, each of the corrugated fins inserted between two respective adjacent ones of the refrigerant tubes, the refrigerant tubes and corrugated fins defining a core having a plurality of air channels for airflow from a first face of the core to a second face of the core, each corrugated fin of the plurality of corrugated fins being formed by a strip having radiused portions alternating with planar portions, wherein the radiused portions are in contact with the respective adjacent refrigerant tubes;
- driving an edge tool along the first face of the core between the respective adjacent refrigerant tubes in a direction parallel to the refrigerant tubes so as to form a respective recessed portion in a plurality of the planar portions; and
- bending the first manifold, the second manifold, and the core about a common bending axis extending parallel to the refrigerant tubes to form a curved portion of the heat exchanger, wherein the curved portion of the heat exchanger includes the recessed portions.

The edge tool is may be driven along the first face of the core at such a depth that the recessed portions are recessed by a depth within a range of 2% to 50% of a local core depth of the heat exchanger.

The step of driving the edge tool along the first face may also bend the fin downward toward the lower manifold.

This step of driving the edge tool may be repeated on a different one of the plurality of corrugated fins.

The first face including the recessed portions may be a curve-inner face of the core or a curve-outer face of the core.

The step of driving the edge tool or a different edge tool may be repeated along the second face of the core between the respective adjacent refrigerant tubes or between different adjacent refrigerant tubes in a direction parallel to the refrigerant tubes so as to form further respective recessed portions in a plurality of the planar portions.

In one version, the edge tool is a folding tool and the recessed portions are formed by folded-down edge portions.

In a different version, the edge tool is a scoring tool and the recessed portions are formed by cut edge portions.

Further details and benefits of the present disclosure will become apparent from the following description of the appended drawings. The drawings are provided herewith solely for illustrative purposes and are not intended to limit the scope of the present invention.

DETAILED DESCRIPTION OF THE DRAWINGS

Figure 1:
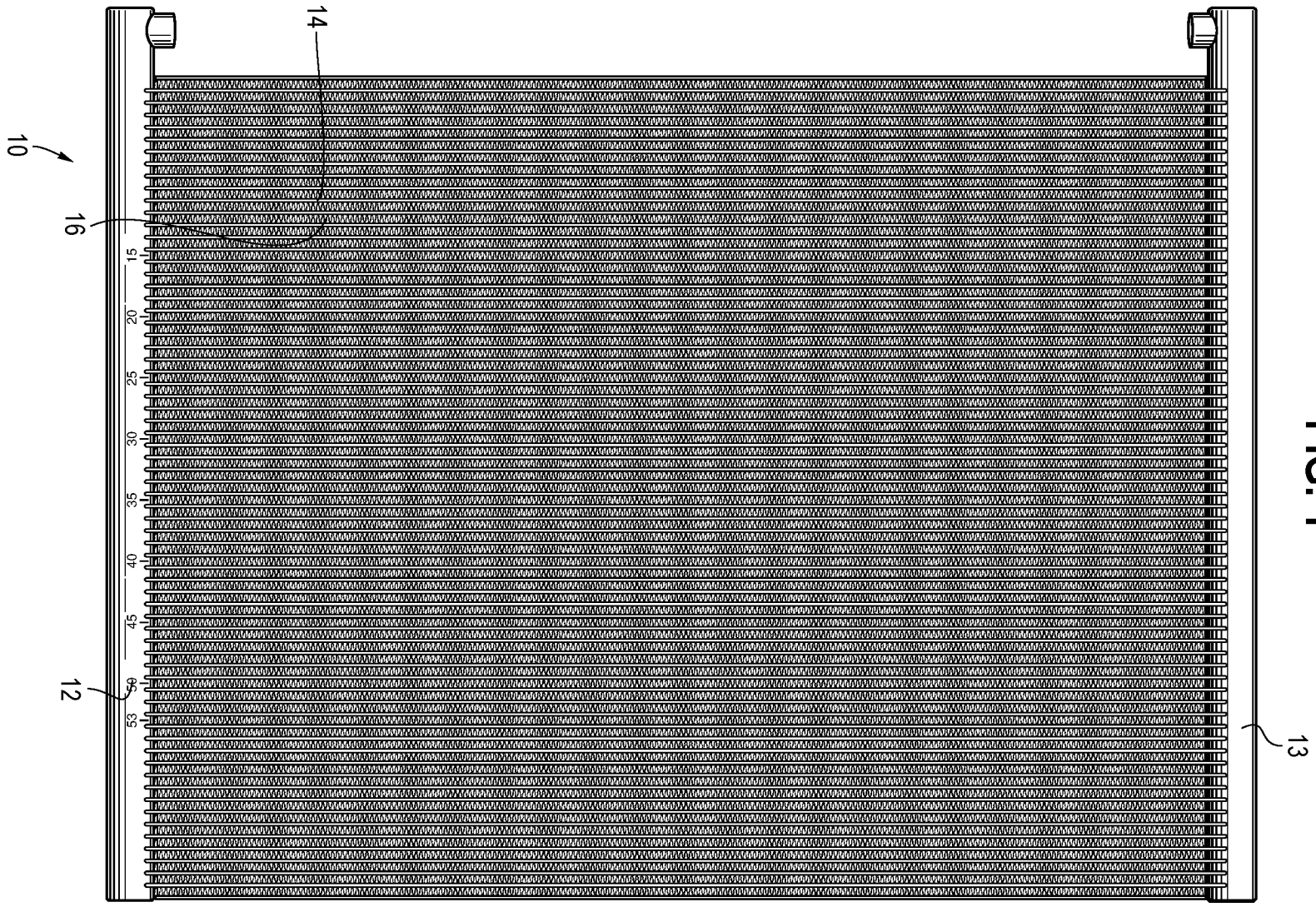
FIG. 1 shows a heat exchanger prior to bending into a curved heat exchanger.

FIG. 1 shows an example of a heat exchanger 10 that, prior to bending, has a horizontal lower straight manifold and a horizontal upper straight manifold, which are spaced apart from each other extend parallel to each other. A plurality of parallel equidistant refrigerant tubes 14 extend from the lower manifold 12 to the upper manifold 13. Each of the refrigerant tubes 14 is in hydraulic communication with the upper and lower manifolds 12 and 13. The lower manifold 12 and the upper manifold 13 are of cylindrical tubular shape, while the refrigerant tubes 14 are flat tubes. Each of the refrigerant tubes 14 may be internally divided into a plurality of microchannels. The flat sides of adjacent flat tubes face each other.

Figure 4A:
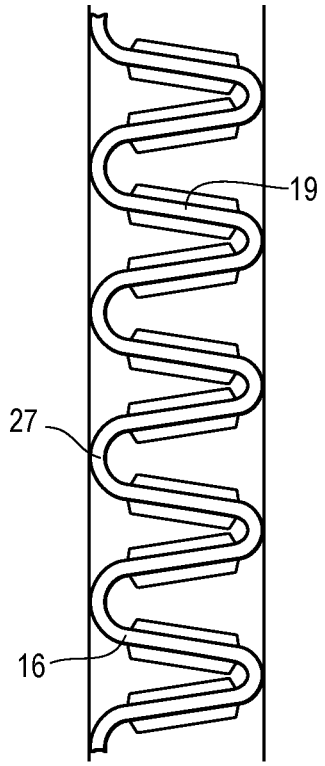
FIG. 4A shows a detail view of a fin prior to applying the folding tool.
Figure 8A:
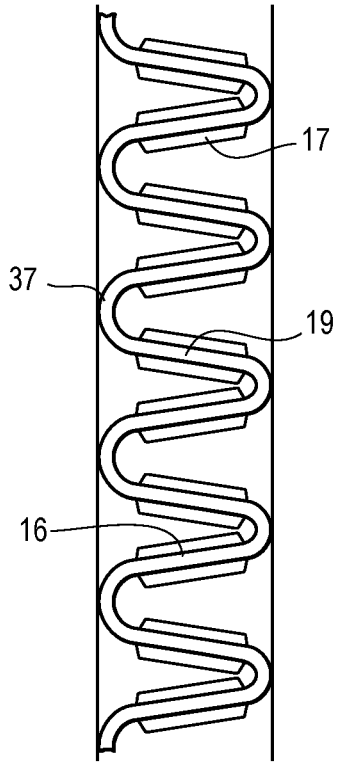
FIG. 8A shows a detail view of a fin prior to applying the scoring tool.

A plurality of corrugated fins are arranged between the refrigerant tubes 14. Each of the corrugated fins spans the distance between respective adjacent ones of the refrigerant tubes 14 so that the refrigerant tubes 14 and corrugated fins form a core of the heat exchanger 10. The corrugation of the fins defines a plurality of air channels from an upstream face of the core to a downstream face of the core. Each corrugated fin 16 of the plurality of corrugated fins is formed by a strip having radiused portions alternating with planar portions 19 as is, for example, shown in FIGS. 4A and 8A. The radiused portions are in contact with the respective adjacent refrigerant tubes 14. FIGS. 4A and 8A also show micro-louvers 17 that may be formed from the strip material of the fin 16 and that are also present in FIG. 11.

When a heat exchanger 10 of the type shown in FIG. 1 is bent about a bend axis that extends parallel to the refrigerant tubes 14, the curve-inner side 38 of the core is laterally compressed, while the curve-outer side 40 of the core is expanded, as will be further discussed below in regards to FIG. 5. As the lower manifold 12 and the upper manifold 13 are bent parallel to each other, forces acting on the core may cause irregular deformation of the refrigerant tubes 14 and of the fins that impairs the optical appearance and may locally reduce the cross-sections of microchannels in some of the refrigerant tubes 14.

Figure 2:
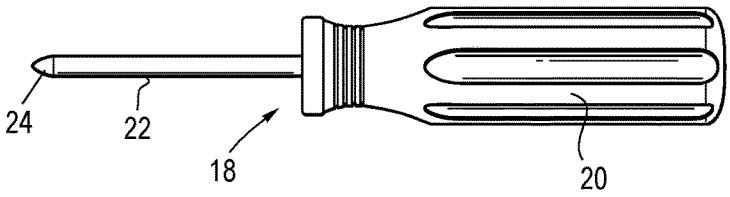
FIG. 2 shows a first edge tool in the form of a folding tool.
Figure 3:
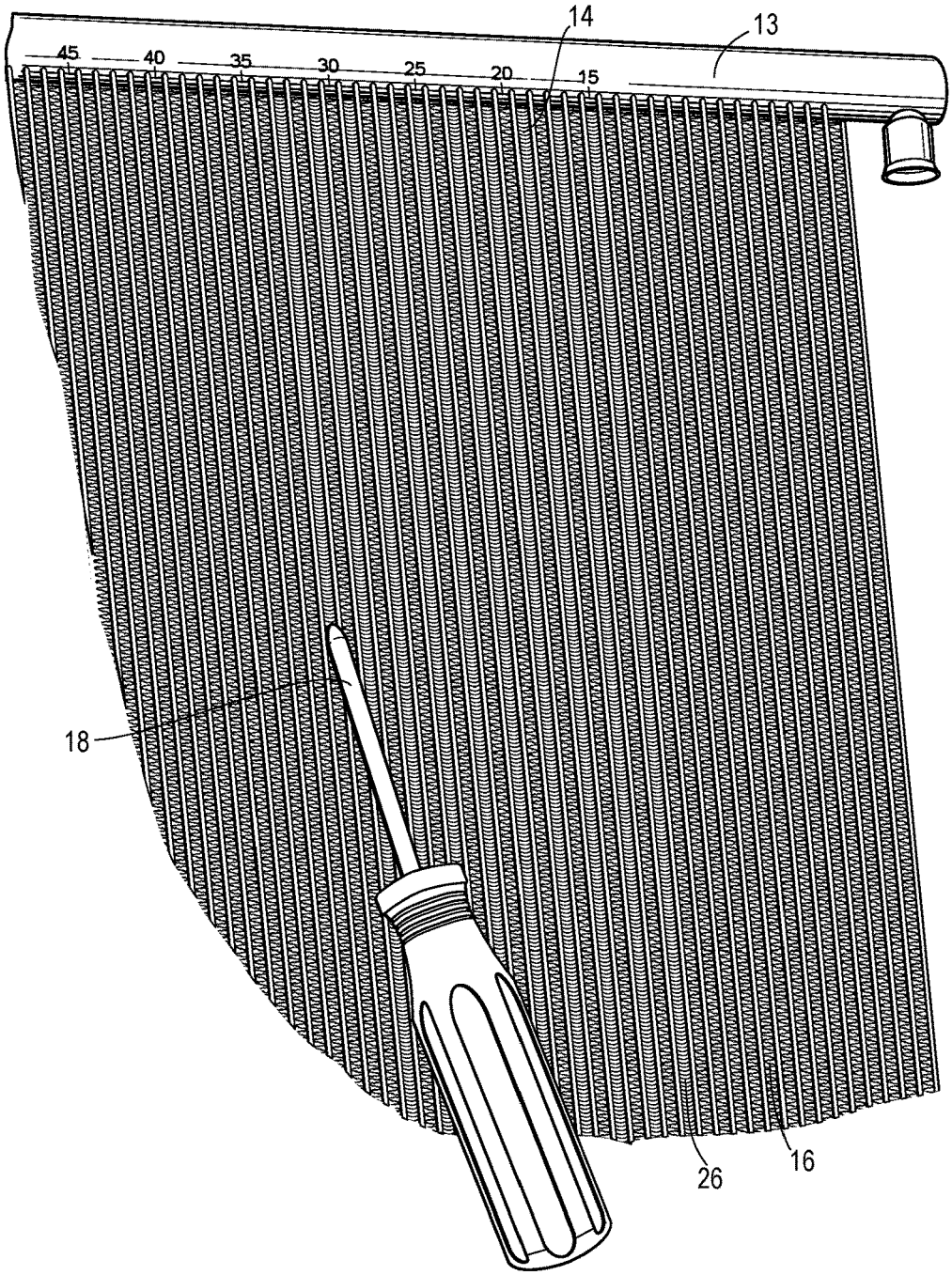
FIG. 3 shows a heat exchanger in the process of folding down edges of corrugated fins.

According to one aspect of the present disclosure, FIGS. 2 and 3 show a process of pre-treating the curve-inner side 38 of a heat exchanger 10 of the type shown in FIG. 1 for facilitating a uniform deformation across the curve inner side of the heat exchanger 10 without the need for protective inserts or complex tools. FIG. 2 shows a simple manual edge tool for creating a deformation of the edges of the fins on the curve-inner side 38. The edge tool of FIG. 2 includes a handle 20, a cylindrical shaft 22, and a conical tip 24. The edge tool forms a folding tool 18 that is run along the curve-inner edges 42 of at least some of the fins in the direction of the refrigerant tubes 14 between two adjacent refrigerant tubes 14. In view of the later use of the heat exchanger 10 that may result in condensed water collecting on the heat exchanger 10 core, it is preferred that the folding tool 18 is run along the fin edges from the upper manifold 13 toward the lower manifold 12 to facilitate the run-off of condensate. In the example shown in FIG. 3, the folding tool 18 is applied to fold down the edges of every other fin 16 arranged within a core section that will be bent in a later step.

The folding tool 18 is preferably held at an angle where the fin 16 is contacted by the blunt annular edge of the transition between the cylindrical shaft 22 and the conical tip 24. The tip 24 of the folding tool 18 may alternatively be a rounded blunt tip 24.

Figure 4B:
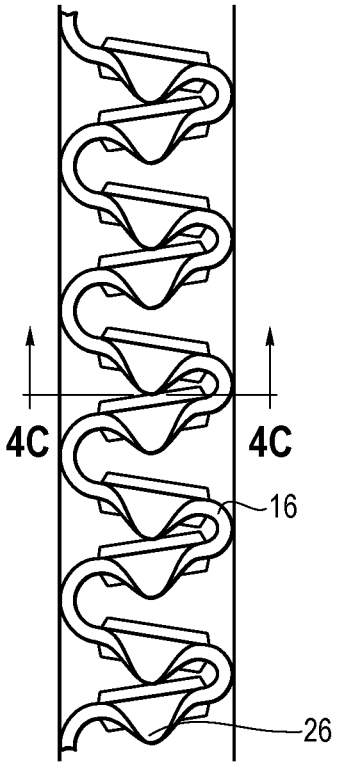
FIG. 4B shows a detail view of a fin after applying the folding tool.

FIG. 4B shows a close-up detail of the folded edge of a fin 16 treated with the folding tool 18. In comparison with FIG. 4A, which shows the untreated fin edges, the edge portions 26 at centers of the planar portions 19 of the fin 16 are all folded down toward the lower manifold 12. The width of the folded edge portions 26 of the fin 16 depends on the diameter of the folding tool 18 used to deform the edge. Preferably, however, the folded edge portions 26 form a central subsection of the planar portions 19, are limited to only the planar portions 19, and do not extend to the radiused portions of the fin 16.

Figure 4C:
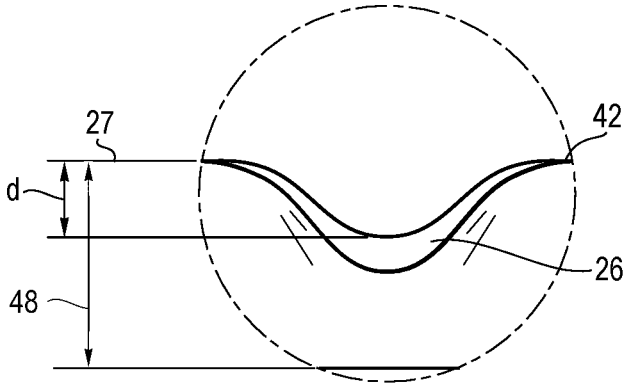
FIG. 4C shows a detail view of the fin of FIG. 4B in a perspective indicated by line C-C of FIG. 4B.

FIG. 4C shows one of the folded-down edge portions of the fin 16 from below as indicated by the line C-C in FIG. 4B. By folding the edge of the fin 16 downward toward the lower manifold 12, the edge is recessed inward toward the center of the core in the folded edge portion 26 relative to an unfolded edge portion 27. The recess depth d of the folded edge portion 26 relative to the unfolded edge portion 27 provides a weakened resistance to bending and thereby a predetermined collapse point when the lower manifold 12, the upper manifold 13, and the core are bent to a desired curvature. The recess depth d of the folded edge portions 26 may be within the range of 2% to 30% of the depth 48 of the heat exchanger core, preferably 4% to 20%, for example within the range of 1 mm to 5 mm for a heat exchanger core having a depth of 2.5 cm (1 inch).

As will be described in more detail below, it has been found that alternating fins having folded edge portions 26 with fins having unfolded edge portions 27 is sufficient to protect the straight configuration of the refrigerant tubes 14 during bending because each refrigerant tube 14 is adjacent to a fin 16 with folded edge portions 26 on one side of the refrigerant tube 14 that provides the predetermined collapse points. It would, however, be within the scope of the present invention if adjacent fins had folded edge portions 26 within the curved section 46 of the heat exchanger 10, or if only every third or fourth fin had folded edge portions, depending on the desired curvature radius of the heat exchanger. A greater curvature radius would require fewer fins with recessed edge portions.

Figure 5:
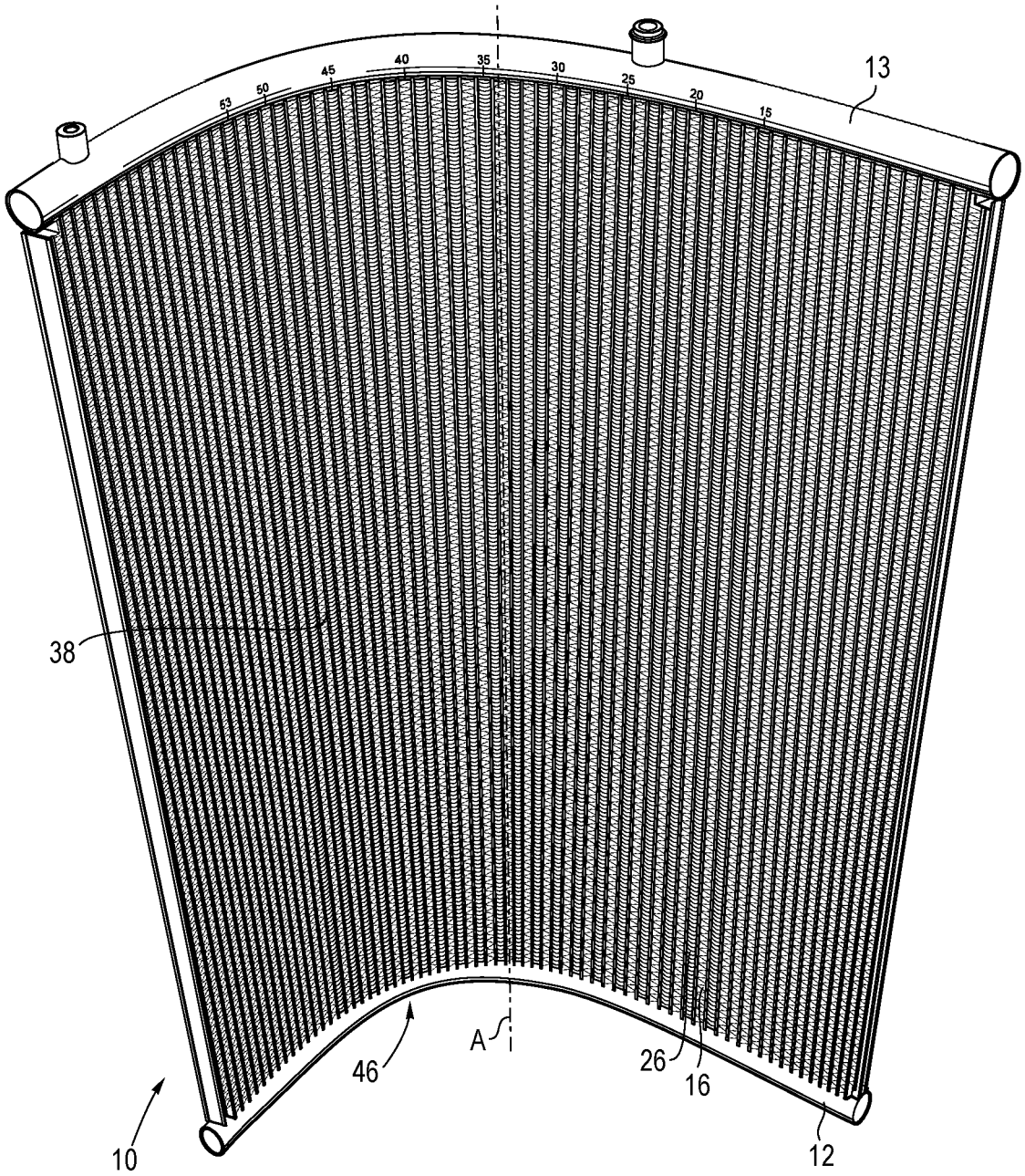
FIG. 5 shows a heat exchanger with folded fin edges after bending the heat exchanger into a curved heat exchanger.

FIG. 5 shows a heat exchanger 10 prepared as discussed above with folded fin edges after bending the upper manifold 13, the lower manifold 12, and the core about a bend axis A into a specified curvature. The bend axis A extends parallel to the refrigerant tubes 14. Because each refrigerant tube 14 within the curved section 46 of the heat exchanger 10 is adjoined by a fin 16 with folded edge portions 26, the refrigerant tubes 14 retain their integrity during the bending process. Accordingly, the refrigerant tubes 14 remain straight after bending. Instead, the folded fins collapse in the locations of the folded edge portions 26 that represent predetermined collapse points.

Figure 6:
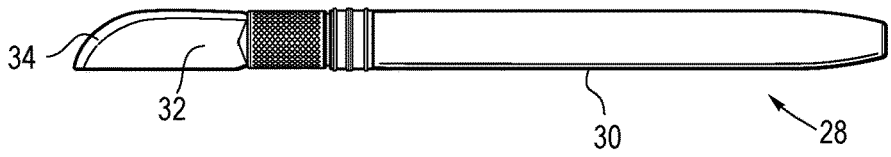
FIG. 6 shows a second edge tool in the form of a scoring tool.

FIGS. 6 through 10 illustrate a variation of producing recessed fin edges that is suitable for curve-inner edges 42 and curve-outer edges 44 of the fins alike. FIG. 6 shows an edge tool used for providing the recessed edge portions according to this variation. The edge tool is a scoring tool 28 with a handle 30, and a blade 32. The blade 32 has a convexly curved cutting edge 34.

Figure 7:
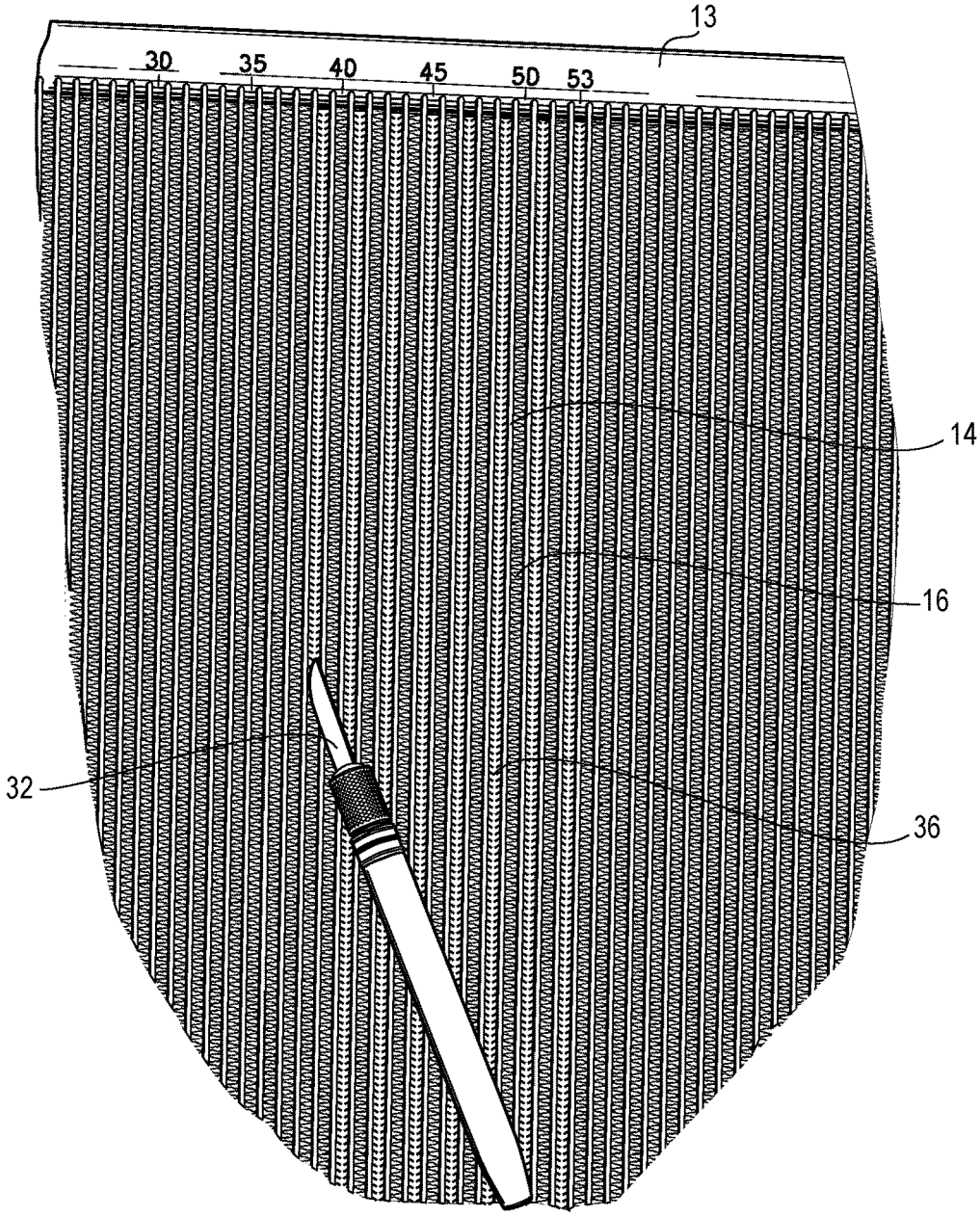
FIG. 7 shows a heat exchanger in the process of cutting edges of corrugated fins.

The scoring tool 28 is run along the curve-inner edges 42 of at least some of the fins in the direction of the refrigerant tubes 14 between two adjacent refrigerant tubes 14. By running the scoring tool 28 along the fin edge as shown in FIG. 7, the fin edges are provided with an incision 35 in a cut edge portion 36. The cut edge portions 36 are located generally centrally in the planar portions 19 of the fin 16. The planar portions 19 immediately adjoining the incision 35 may be pulled in the direction of movement of the scoring tool 28. In view of the later use of the heat exchanger 10 that may result in condensed water collecting on the heat exchanger 10 core, it is thus preferred that the scoring tool 28 is run along the fin edges from the upper manifold 13 toward the lower manifold 12 to facilitate the run-off of condensate. In the example shown in FIG. 7, the scoring tool 28 is applied to cut the edges of every other fin 16 arranged within a core section that will be bent in a later step.

The scoring tool 28 is preferably held at an angle where the fin 16 is contacted by the convexly curved cutting edge 34 of the blade 32. The scoring tool 28 may alternatively have a rounded blade 32 extending at a different angle relative to the handle, for example generally perpendicular to the handle.

Figure 8B:
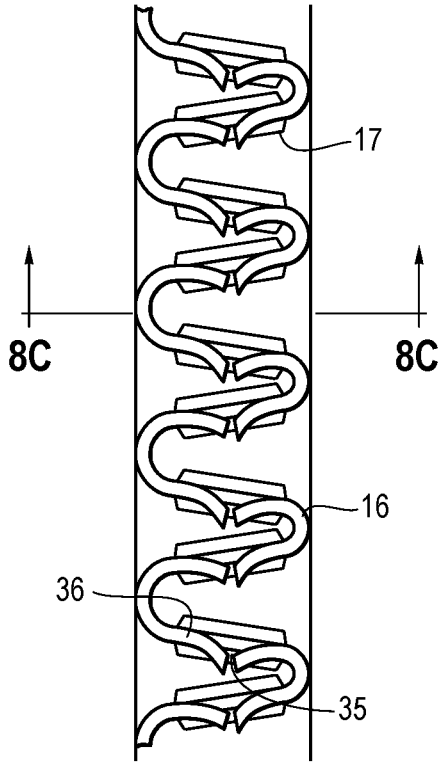
FIG. 8B shows a detail view of a fin after applying the scoring tool.

FIG. 8B shows a close-up detail of the cut edge portion 36 of a fin 16 treated with the scoring tool 28. In comparison with FIG. 8A, which shows the untreated fin edges, the edge portions 36 at centers of the planar portions 19 of the fin 16 are all cut inward and slightly bent downward toward the lower manifold 12. The extent of the downward bend of the lateral sides of the incisions 35 depends on the blade 32 of the scoring tool 28 used to deform the edge and on the stiffness of the fin 16 material. Preferably, however, the cut edge portions 36 including the bent sides form a central subsection of the planar portions 19, are limited to only the planar portions 19, and do not extend to the radiused portions of the fin 16.

Figure 8C:
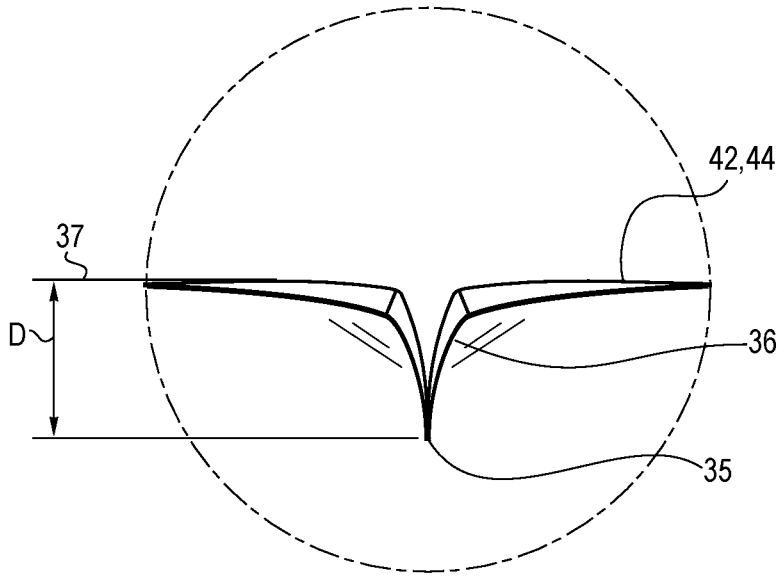
FIG. 8C shows a detail view of the fin of FIG. 8B in a perspective indicated by line C-C of FIG. 8B.

FIG. 8C shows one of the cut edge portions 36 of the fin 16 from below as indicated by the line C-C in FIG. 8B. By cutting the edge of the fin 16, the edge is recessed inward toward the center of the core in the cut edge portion 36 relative to an uncut edge portion 37. The recess D of the cut edge portion 36 relative to the uncut edge portion 37 provides a weakened resistance to bending or tearing and thereby a predetermined collapse point or tear line when the lower manifold 12, the upper manifold 13, and the core are bent to a desired curvature. The recess depth D of the cut edge portions 36 may be within the range of 5% to 50% of the depth of the core, preferably within the range of 10% to 30%.

As the recesses in the fin edges are formed by incisions 35, not just folds, these edges can be collapsed on the curve-inner side 38 of or expanded on the curve-outer side 40 of a curved heat exchanger 10. It has been found that alternating fins having cut edges with fins having uncut edges 37 is sufficient to protect the straight configuration of the refrigerant tubes 14 during bending because each refrigerant tube 14 is adjacent to a fin 16 with cut edge portions 36 on one side of the refrigerant tube 14 that provides the predetermined collapse points or tear lines. It would, however, be within the scope of the present invention if adjacent fins had cut edge portions 36 within the curved section 46 of the heat exchanger 10, or if only every third or fourth fin had cut edge portions, depending on the desired curvature radius of the heat exchanger. A greater curvature radius would require fewer fins with recessed edge portions.

Figure 9:
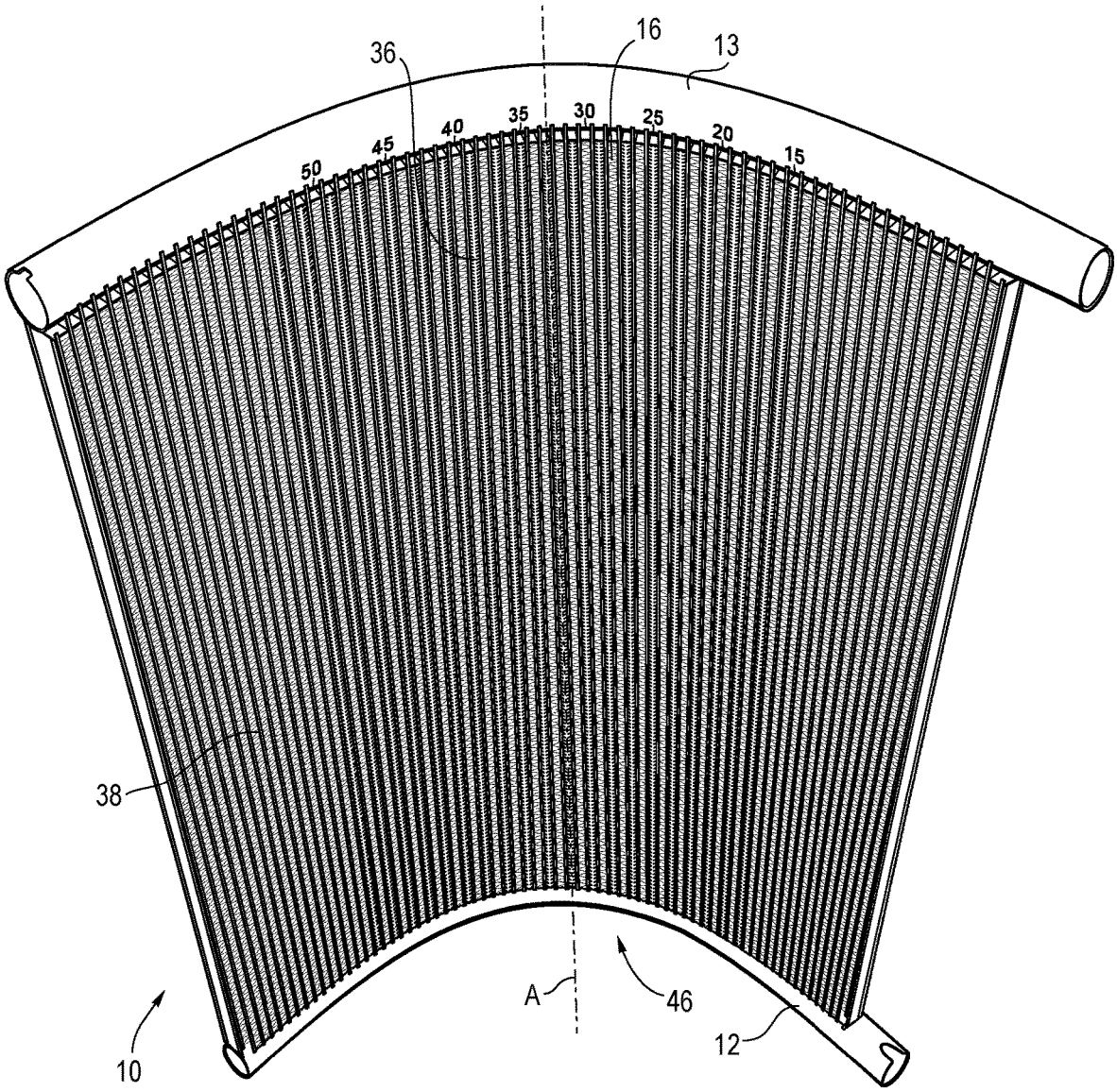
FIG. 9 shows a curve-inner side of a heat exchanger with cut fin edges after bending the heat exchanger into a curved heat exchanger.

FIG. 9 shows a heat exchanger 10 prepared as discussed above with cut fin edges after bending the upper manifold 13, the lower manifold 12, and the core about a bend axis A into a specified curvature such that the cut fin edges are on the curve-inner side 38 of the curved heat exchanger 10. The bend axis A extends parallel to the refrigerant tubes 14. Because each refrigerant tube 14 within the curved section 46 of the heat exchanger 10 is adjoined by a fin 16 with cut edge portions 36, the refrigerant tubes 14 retain their integrity during the bending process. Accordingly, the refrigerant tubes 14 remain straight after bending. Instead, the cut fins collapse in the locations of the cut edge portions 36 that represent predetermined collapse points.

Figure 10:
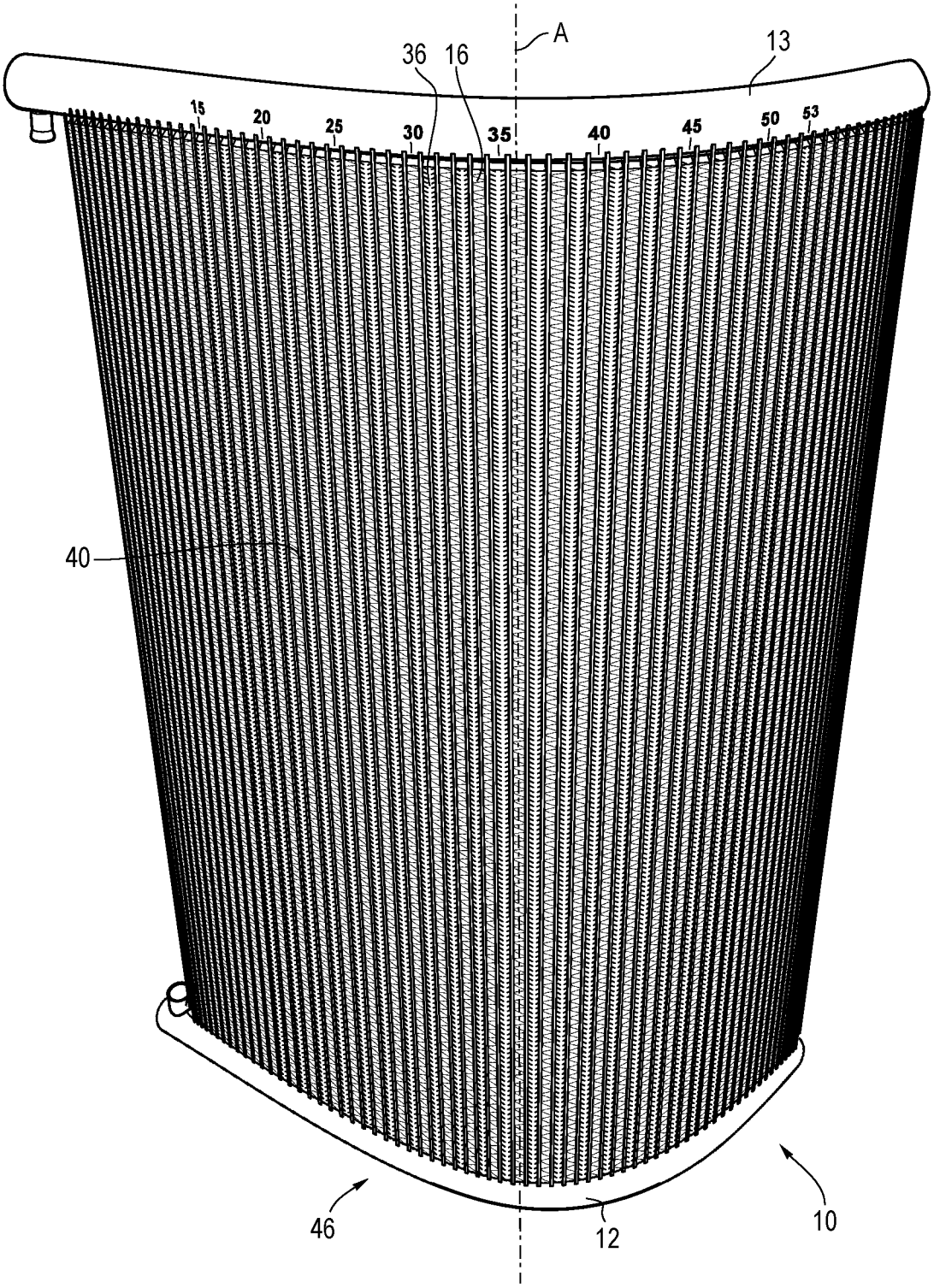
FIG. 10 shows a curve-outer side of the heat exchanger of FIG. 5 or of a different heat exchanger with cut fin edges after bending the heat exchanger into a curved heat exchanger.

FIG. 10 shows another heat exchanger 10 prepared as discussed above with cut fin edges after bending the upper manifold 13, the lower manifold 12, and the core about a bend axis A into a specified curvature such that the cut fin edges are on the curve-outer side 40 of the curved heat exchanger 10. The bend axis A again extends parallel to the refrigerant tubes 14. Because each refrigerant tube 14 within the curved section 46 of the heat exchanger 10 is adjoined by a fin 16 with cut edge portions 36, the refrigerant tubes 14 retain their integrity during the bending process. Accordingly, the refrigerant tubes 14 remain straight after bending. Instead, the cut fins spread apart in the locations of the cut edge portions 36 that represent predetermined tear lines.

The principles of FIGS. 9 and 10, or of FIGS. 3 and 10, while shown on different heat exchanger 10*s*, may be combined on a single heat exchanger 10. For example, both the curve-inner and the curve-outer fin edges may carry incisions 35, thus combining the features of FIG. 9 and FIG. 10. Where only every other fin edge is cut on a given side of the heat exchanger 10, the incisions 35 on the curve-outer side 40 may be made in fins that also carry incisions 35 on the curve-inner side 38. Alternatively, each of the fins within the curved portion of the heat exchanger 10 may have a cut edge, alternating between the curve-inner edge 42 and the curve outer edge of adjacent fins.

Also, as discussed above, while the curve outer side of the heat exchanger 10 may have cut fin edges, the curve-inner side 38 of the heat exchanger 10 may have folded fin edges. Again, where only every other fin edge is cut on the curve-outer side 40 and folded on the curve-inner side 38 of the heat exchanger 10, the incisions 35 on the curve-outer side 40 may be made in fins that also carry folds on the curve-inner side 38.

Figure 11:
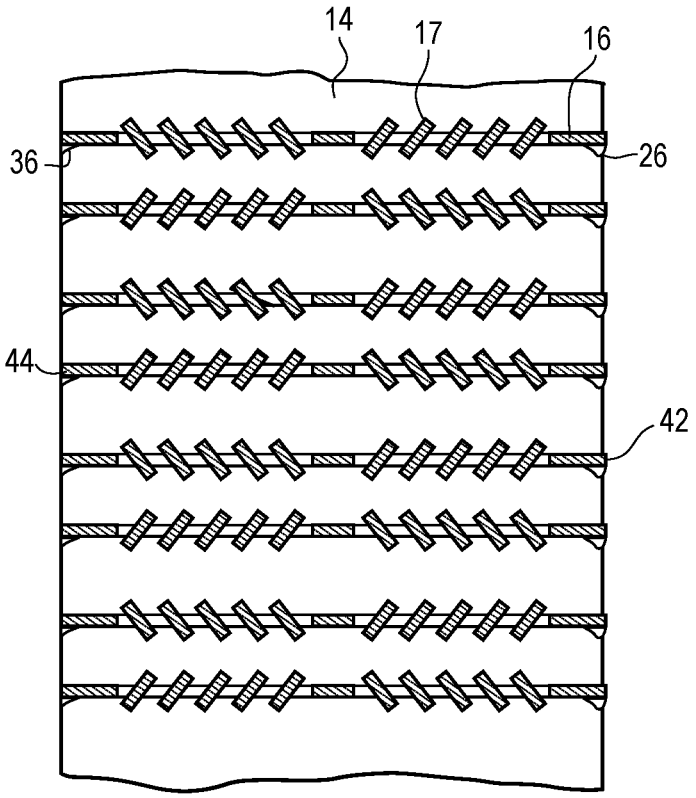
FIG. 11 shows a cross-sectional detail view of a heat exchanger with both cut and folded fin edges.

This is illustrated in FIG. 11, showing a vertical cross-sectional cut through one of the corrugated fins. The curve-inner side 38 of the fin 16 features folded edge portions 26, while the curve-outer side 40 features cut edge portions 36. Alternatively, each of the fins within the curved portion of the heat exchanger 10 may have one of a cut edge and a folded edge, alternating between the curve-inner edge 42 being folded and the curve outer edge being cut from one fin 16 to the next.

Figure 12:
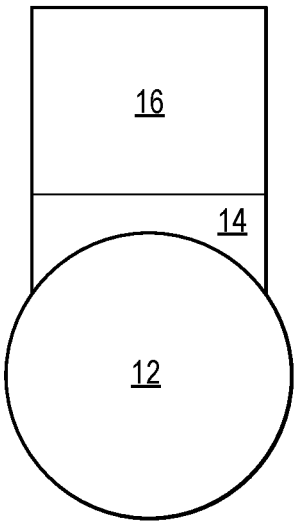
FIG. 12 shows a schematic cross-sectional detail view of a heat exchanger with a full core.
Figure 13:
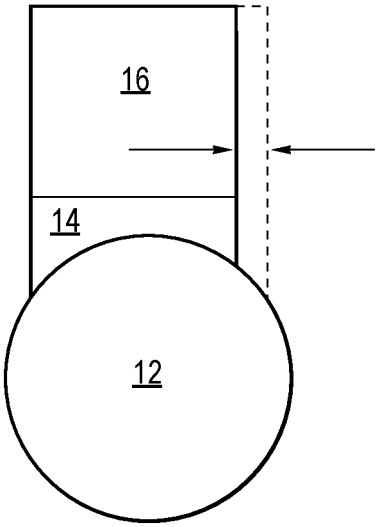
FIG. 13 shows a schematic cross-sectional detail view of a heat exchanger with a recessed core.

Combining the principles of FIGS. 9 and 10, or of FIGS. 3 and 10 is of particular interest in heat exchanger 10*s* having a full core as shown in FIG. 12, where the core composed of the refrigerant tubes 14 and fins extends equally far to the curve-inner side 38 and curve-outer side 40 of the manifold. Some heat exchangers 10 are designed to have a recessed core as shown in FIG. 13, at least in the curved section 46 of the heat exchanger 10. This recess may be on the curve-outer side 40 or the curve-inner side 38, or on both sides 38 and 40. The entire curved core section may be recessed on one side so that no cut edge portions 36 or folded edge portions 26 may be necessary on that side. If only one side of the curved core section is recessed without any treated edge portions, the recessed side is preferably the curve-outer side so that the cut edge portions 36 or folded edge portions 26 are located on the curve-inner side, which is less visible in the installed state of the heat exchanger. That way, the curve-outer side has an optically more appealing appearance. The recessed side of the core may be close enough to the central axis of the manifold that the compression or expansion between the refrigerant tubes 14 is sufficiently reduced to avoid deformations of the refrigerant tubes 14. Alternatively, the even the fin edges of a recessed core section may be folded or cut.

It should be noted that the step of folding or cutting the fin edges in the planar portions has been described as a manual process. This process, however, can easily be performed by a machine providing a linear movement of a rake-like attachment, in which each of the rake teeth is formed of an edge tool as described. The edge tools may be interchangeable between a folding tool and a cutting tool. Further, the lateral distances between the rake teeth may be adjustable to account for different requirements.

While the above description constitutes the preferred embodiments of the present invention, it will be appreciated that the invention is susceptible to modification, variation and change without departing from the proper scope and fair meaning of the accompanying claims.

What is claimed is:

1. A method of making a curved heat exchanger, the method comprising the following steps:

assembling parts of the heat exchanger, the parts, after assembly, form a flat heat exchanger including:

an upper manifold having a straight elongated shape;

an lower manifold spaced from and extending parallel to the upper manifold;

refrigerant tubes, each refrigerant tube of the plurality of refrigerant tubes extending along a tube length with one tube end attached to the upper manifold and another tube end attached to the lower manifold; and corrugated fins, each of the corrugated fins inserted between two respective adjacent ones of the refrigerant tubes, the refrigerant tubes and corrugated fins defining a core having a plurality of air channels for airflow from a first face of the core to a second face of the core, each of the corrugated fins being formed by a strip having radiused portions alternating with planar portions, wherein the radiused portions are in contact with the respective adjacent ones of the refrigerant tubes;

driving an edge tool along the first face of the core between the respective adjacent ones of the refrigerant tubes in a direction parallel to each of the refrigerant tubes so as to form a respective recessed portion in a plurality of the planar portions; and bending the upper manifold, the lower manifold, the second manifold, and the core about a common bending axis extending parallel to the refrigerant tubes to form a curved portion of the heat exchanger, wherein the curved portion of the heat exchanger includes the recessed portions.

2. The method according to claim 1, wherein the edge tool is driven along the first face of the core at such a depth that the recessed portions are recessed by a depth within a range of 2% to 50% of a local-core depth of the heat exchanger.

3. The method according to claim 1, wherein the step of driving the edge tool along the first face also bends the fin downward toward the lower manifold.

4. The method according to claim 1, comprising the further step of driving the edge tool along the first face of the core between additional two adjacent refrigerant tubes so as to form the recessed portion in a plurality of the planar portions of a different one of the plurality of corrugated fins.

5. The method according to claim 1, wherein the first face including the recessed portions is a curve-inner face of the core.

6. The method according to claim 1, wherein the first face including the recessed portions is a curve-outer face of the core.

7. The method according to claim 1, comprising the further step of driving the edge tool or a different edge tool along the second face of the core between the respective adjacent refrigerant tubes or between different adjacent refrigerant tubes in a direction parallel to the refrigerant tubes so as to form further respective recessed portions in a plurality of the planar portions.

8. The method according to claim 1, wherein the edge tool is a folding tool and the recessed portions are formed by folded-down edge portions.

9. The method according to claim 1, wherein the edge tool is a scoring tool and the recessed portions are formed by cut edge portions.

* * * * *